US006121868A

United States Patent [19]

Chiang

[11] Patent Number: 6,121,868

[45] Date of Patent: Sep. 19, 2000

[54] ELECTRIC SWITCH DEVICE WHICH CAN PREVENT DAMAGE TO IT AND DEVICES CONNECTED TO IT

[75] Inventor: Yi-Te Chiang, Taipei, Taiwan

[73] Assignee: Primax Electronics Ltd., Taipei Hsien, Taiwan

[21] Appl. No.: 09/275,085

[22] Filed: Mar. 24, 1999

[30] Foreign Application Priority Data

Dec. 24, 1998 [TW] Taiwan ..... 87121613

[51] Int. Cl.[7] ..... H01H 37/02; H01H 37/32; H01H 37/46; H01H 37/52

[52] U.S. Cl. ..... 337/37; 333/39; 333/59; 333/85; 333/112; 333/113

[58] Field of Search ..... 337/79, 59, 66, 337/334, 345, 76, 53, 67, 68, 69, 74, 75, 91, 140, 39, 85, 112, 113; 200/553–557

[56] References Cited

U.S. PATENT DOCUMENTS

| | | | |
|---|---|---|---|
| 2,335,082 | 11/1943 | Platz | 337/66 |
| 2,563,175 | 8/1951 | Kitman | 337/66 |
| 2,768,262 | 10/1956 | Allard | 337/60 |
| 3,119,912 | 1/1964 | Fehrenbach et al. | 337/66 |
| 3,358,099 | 12/1967 | Bellomayre | 337/53 |
| 3,846,729 | 11/1974 | Sorimachi | 337/343 |
| 4,337,450 | 6/1982 | Matthies | 337/66 |
| 4,510,479 | 4/1985 | Merchant | 337/91 |
| 5,498,846 | 3/1996 | Chin | 200/557 |
| 5,760,672 | 6/1998 | Wang | 337/79 |
| 5,847,638 | 12/1998 | Sorenson | 337/380 |
| 5,861,794 | 1/1999 | Pellon | 337/365 |
| 5,892,426 | 4/1999 | Huang | 337/59 |

FOREIGN PATENT DOCUMENTS

| | | | |
|---|---|---|---|
| 3145954 | 6/1983 | Germany | H01H 23/16 |
| 3629290 | 5/1988 | Germany | H01H 23/16 |
| 2137415 | 10/1984 | United Kingdom | H01H 21/06 |
| 2199189 | 6/1988 | United Kingdom | H01H 23/20 |

*Primary Examiner*—Leo P. Picard
*Assistant Examiner*—Anatdy Vortman
*Attorney, Agent, or Firm*—Winston Hsu

[57] ABSTRACT

The present invention provides an electric device comprising two electric terminals, a button mechanism having a push button that can depressed to toggle between "on" and "off" statuses, and a conductive reed that conducts electric current between the two electric terminals when connected and disables the passage of current when disconnected. When the button is set "on", a reserve space exists between the reed and the button for the reed to spring upward without pushing the button upward. When the current passing through the reed exceeds a predetermined current level, the reed will become heated and spring upward and rest in the reserve space so as to electrically disconnect the two electric terminals.

6 Claims, 8 Drawing Sheets

ELECTRIC SWITCH DEVICE WHICH CAN PREVENT DAMAGE TO IT AND DEVICES CONNECTED TO IT

BACKGROUND OF THE INVENTION

1. Field of the Invention

The invention relates to an electric switch device, and more particularly, to an electric switch device which can prevent damages to it and devices connected to it.

2. Description of the Prior Art

Please refer to FIG. 1 and FIG. 2. FIG. 1 is a cross-sectional view of a prior art electric switch device 10 in an "off" status. FIG.2 is a cross-sectional view of the electric switch device 10 in FIG.1 in an "on" status. The electric switch device 10 comprises a housing 12, two electric terminals 14 and 16, a button 18, a conductive reed 20, a connecting rod 26 connected between the button 18 and the reed 20, and an elastic piece 24 installed between the housing 12 and a front end of the reed 20 for elastically fixing the front end of the reed 20 in an "up" position (as shown in FIG. 1) or in a "down" (as shown in FIG. 2) position. The button 18 can be depressed to toggle between the "on" status and the "off" status. When a first end 19 of the button 18 is depressed, the connecting rod 26 will push the reed 20 downward to connect the two electric terminals 14, 16, and the elastic piece 24 will elastically move and fix the front end of the reed 20 to the "down" position. Then, the reed 20 connects the two electric terminals 14, 16 and allows electric current to pass between the two electric terminals 14, 16 (as shown in FIG. 2). When a second end 21 of the button 18 is depressed, the connecting rod 26 will move the reed 20 upward, and the elastic piece 24 will elastically move and fix the front end of the reed 20 in the "up" position. Then, the electric terminal 14 will disconnect from the electric terminal 16 thus disabling electric current from passing between the two electric terminals 14, 16.

The reed 20 is formed by combining two metal pieces of different heat expansion coefficients whereby when the current passing through the reed 20 exceeds the predetermined current level, the front end of the reed 20 will spring upward because of the heat generated by the current. When the reed 20 springs upward to push the connecting rod 26 and the button 18 upward, the button 18 will be set "off". At this time, if the user depresses the button 18 to set the electric switch device 10 "on", the electric switch device 10 and the device connected to the electric switch device 10 will be damaged. Furthermore, if the button is damaged or becomes depressed such that it cannot be switched and the current passing through the reed 20 exceeds the predetermined current level, the reed 20 cannot spring upward. Therefore, the electric terminal 14 can not disconnect from the electric terminal 16 and the electric switch device 10 remains "on". This may damage the electric switch device 10 and devices connected to the electric switch device 10.

SUMMARY OF THE INVENTION

It is therefore a primary objective of the present invention to provide an electric switch device to solve the above mentioned problems.

Briefly, in a preferred embodiment, the present invention provides an electric switch device comprising:

a housing;

two electric terminals installed in the housing;

a button mechanism installed in the housing comprising a push button which can be depressed to toggle between "on" and "off" status; and a conductive reed installed in the housing for conducting electric current between the two electric terminals, wherein when the button is pressed "on", the reed connects the two electric terminals and allows electric current to pass between the two electric terminals, and when the button is pressed "off", the reed disconnects from at least one of the two electric terminals thus disabling electric current from passing between the two electric terminals;

wherein when the button is set "on", a reserve space exists between the reed and the button for the reed to spring upward without pushing the button upward, and when the current passing through the reed exceeds a predetermined current level, the reed will become heated and spring upward and rest in the reserve space so as to electrically disconnect the two electric terminals.

It is an advantage of the present invention that when the button is set "on", a reserve space exists between the reed and the button. When the current passing through the reed exceeds a predetermined current level, the reed will pop up to the reserve space without pushing the button upward to prevent the electric switch device and devices connected to the electric switch device from being damaged.

These and other objects and the advantages of the present invention will no doubt become obvious to those of ordinary skill in the art after having read the following detailed description of the preferred embodiment that is illustrated in the various figures and drawings.

DETAILED DESCRIPTION OF THE PREFERRED EMBODIMENT

Figure 1:
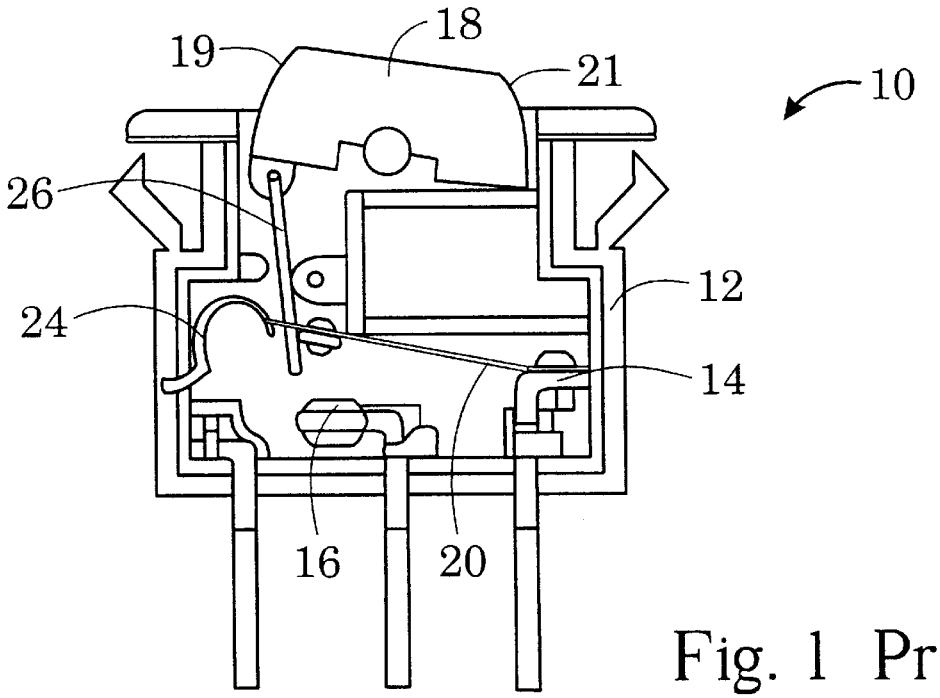
Fig. 1 Prior art
FIG. 1 is a cross-sectional view of a prior art electric switch device in an "off" status.
Figure 2:
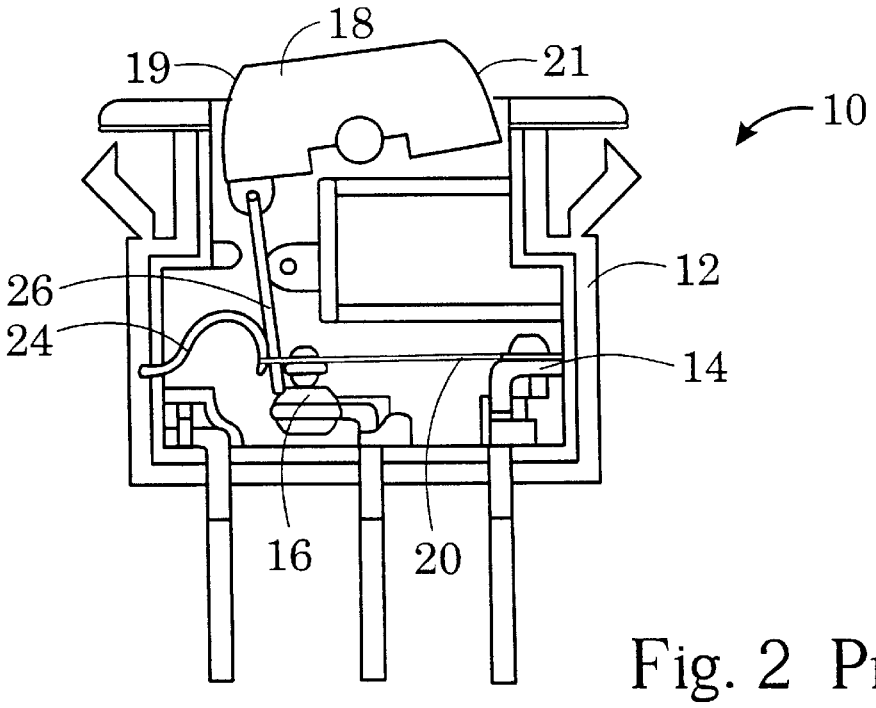
Fig. 2 Prior art
FIG. 2 is a cross-sectional view of the electric switch device in FIG. 1 in an "on" status.
Figure 3:
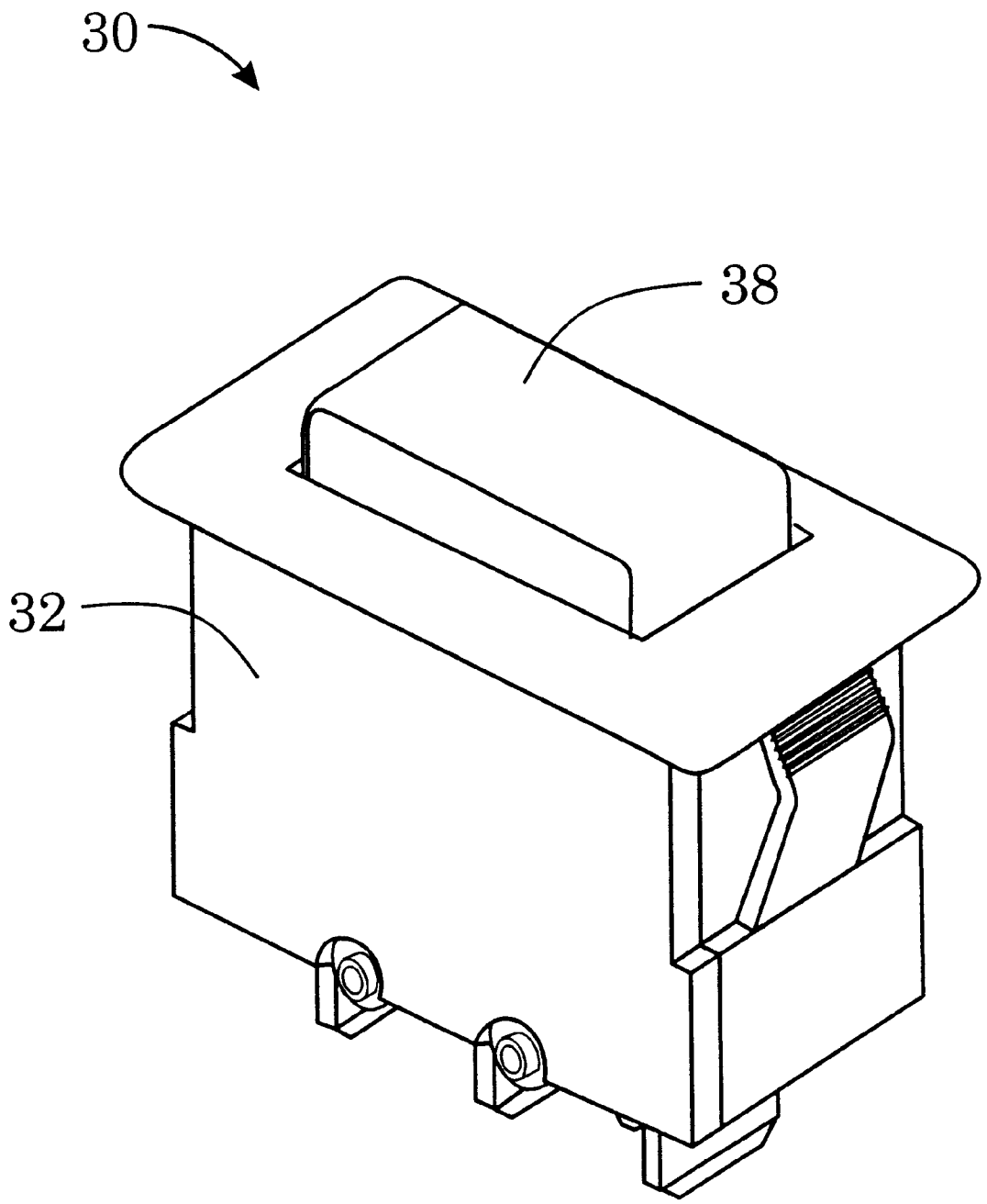
FIG. 3 is a perspective view of an electric switch device according to the present invention.
Figure 4:
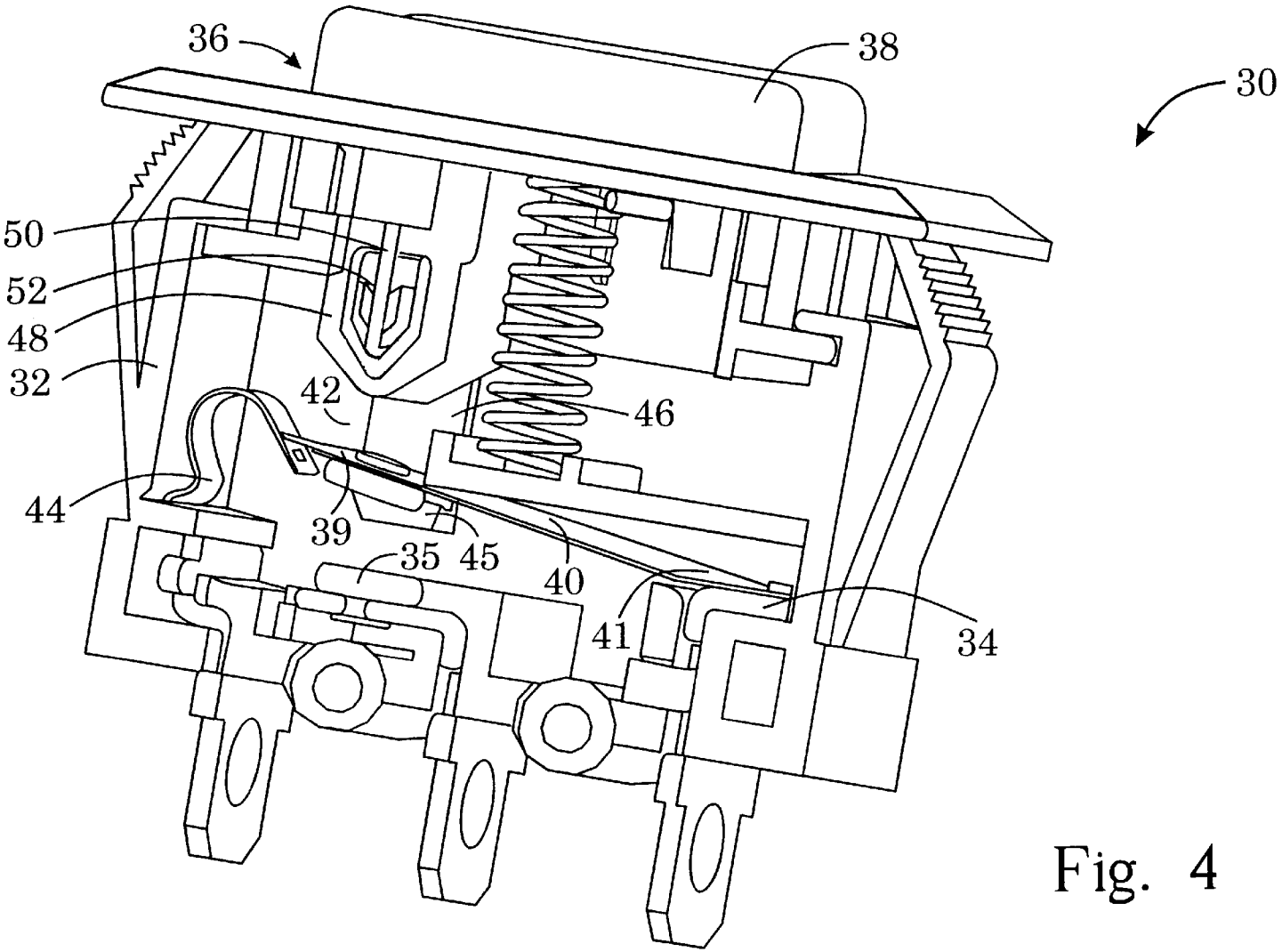
FIG. 4 is an internal structure of the electric switch device in FIG. 3 in an "off" status.
Figure 5:
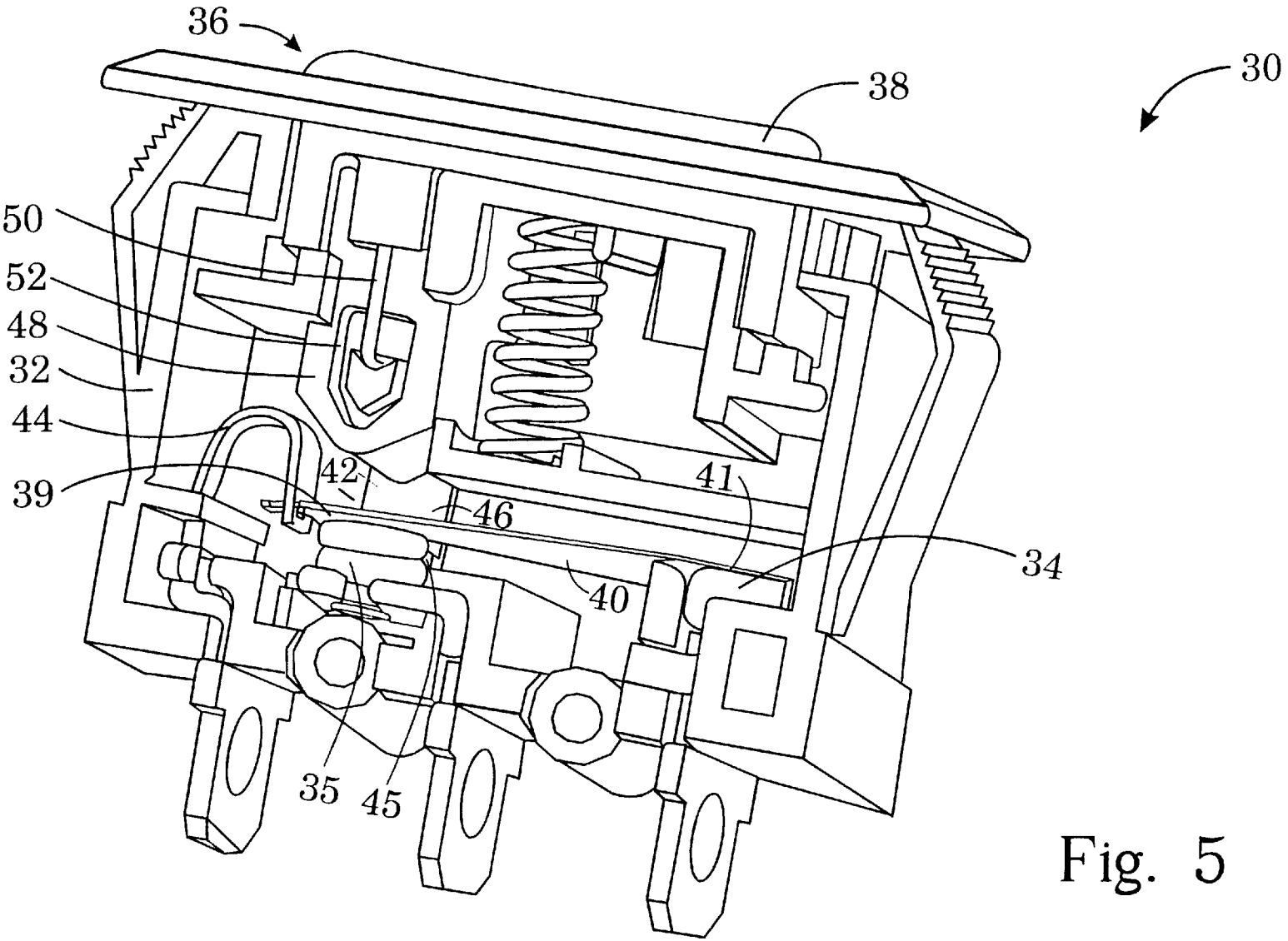
FIG. 5 is an internal structure of the electric switch device in FIG. 3 in an "on" status.

Please refer to FIG. 3 to FIG. 5. FIG. 3 is a perspective view of an electric switch device 30 according to the present invention. FIG. 4 is an internal structure of the electric switch device 30 in FIG. 3 in an "off" status. FIG. 5 is an internal structure of the electric switch device 30 in FIG. 3 in an "on" status. The electric switch device 30 comprises a housing 32, two electric terminals 34, 35 installed in the housing 32, a button mechanism 36 installed in the housing 32, a conductive reed 40 installed in the housing 32 for conducting electric current between the two electric terminals 34, 35, and an elastic piece 44 installed between the housing 32 and a front end 39 of the reed 40 for elastically fixing the front end 39 of the reed 40 in an "up" (as shown in FIG. 4) or "down" (as shown in FIG. 5) position.

The butt on mechanism 36 comprises a push button 38, a hook 46 installed below the button 38, a switching device 48 installed on an upper side of the hook 46, and a connecting rod 50. The push button 38 can be depressed to toggle between "on" and "off" statuses. The switching device 48 comprises a slot 52, and the connecting rod 50 can move upward and downward in the slot 52. FIG. 5 shows the position of the connecting rod 50 in the slot 52 and the position of a lower side 45 of the hook 46 in the housing 32 when the button 38 is pressed "on". FIG. 4 shows the position of the connecting rod 50 in the slot 52 and the position of the lower side 45 of the hook 46 in the housing 32 when the button 38 is pressed "off".

The reed 40 comprises a rear end 41 fixed to a first electric terminal 34 and electrically connected to the first electric terminal 34, and a front end 39 moveably positioned above a second electric terminal 35 and between the switching device 48 and the lower side 45 of the hook 46.

When the button 38 is pressed "on" (as shown in FIG. 5), a lower side of the switching device 48 will push the front end 39 of the reed 40 downward to touch the second electric terminal 35, and the elastic piece 44 will elastically move and fix the front end 39 of the reed 40 to the "down" position. Then, the reed 40 connects the two electric terminals 34, 35 and allows electric current to pass between the two electric terminals 34, 35. When the button 38 pops up to the "off" position (as shown in FIG. 4), the lower side 45 of the hook 46 will move the front end 39 of the reed 40 upward to leave the second electric terminal 35, and the elastic piece 44 will elastically move and fix the front end 39 of the reed 40 to the "up" position. Then, the second electric terminal 35 will disconnect from the first electric terminal 34 thus disabling electric current from passing between the two electric terminals 34, 35.

Figure 6:
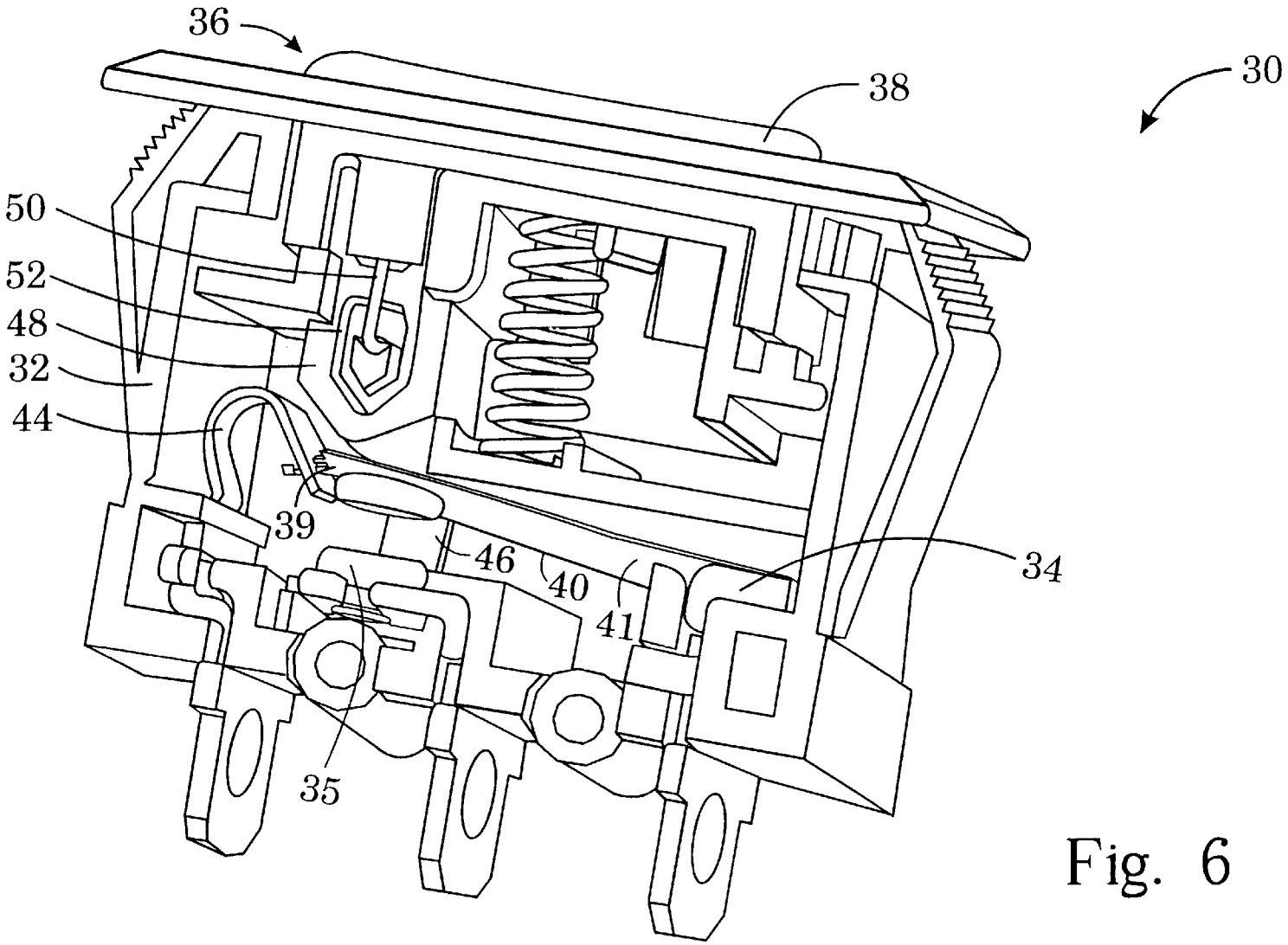
FIG. 6 is an internal structure of the electric switch device in FIG. 3 in an "overheated" status.

Please refer to FIG. 6. FIG. 6 is an internal structure of the electric switch device 30 in FIG. 3 in an "overheated" status. The reed 40 is formed by combining two metal pieces of different heat expansion coefficients whereby when the current passing through the reed 40 exceeds the predetermined current level, the front end 39 of the reed 40 will spring upward because of the heat generated by the current. As shown in FIG. 5, when the button 38 is set "on", a reserve space 42 exists above the reed 40 for the reed 40 to spring upward without pushing the button 38 upward. When the current passing through the reed 40 exceeds the predetermined current level, the elastic piece 44 will elastically fix the front end 39 of the reed 40 to the "up" position to disconnect the second electric terminal 35 from the first electric terminal 34 thus disabling electric current from passing between the two electric terminals 34, 35.

As shown in FIG. 6, although the electric switch device 30 is in an "off" status, the button 38 is set "on" and the connecting rod 50 and the lower side 45 of the hook 46 are at "on" positions. When the user depresses the button 38, the button 38 will be set "off" and the connecting rod 50 and the lower side 45 of the hook 46 will be at "off" positions (as shown in FIG. 4). When the user depresses the button 38 again, the electric switch device 30 will be in an "on" status (as shown in FIG. 5).

When the reed 40 springs upward because of the heat, the front end 39 of the reed 40 will stay in the reserve space 42 without pushing the button 38 upward. If the button 38 is damaged or is depressed such that it cannot be switched, the reed 40 still can spring upward. Then, the second electric terminal 35 will disconnect from the first electric terminal 34 to prevent the electric switch device 30 and devices connected to the electric switch device 30 from being damaged.

Figure 7:
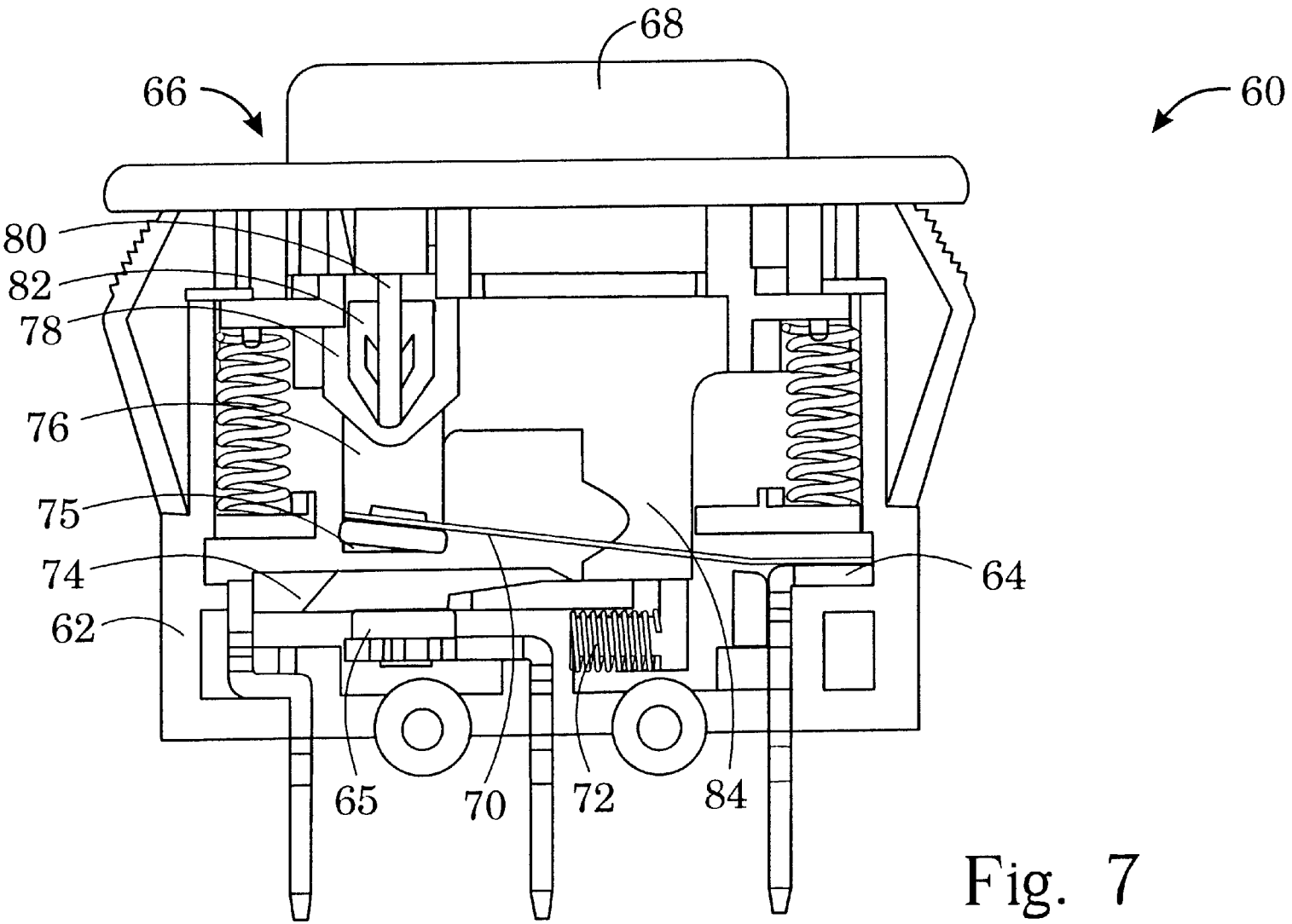
FIG. 7 is a cross-sectional view of another electric switch device in an "off" status according to the present invention.
Figure 8:
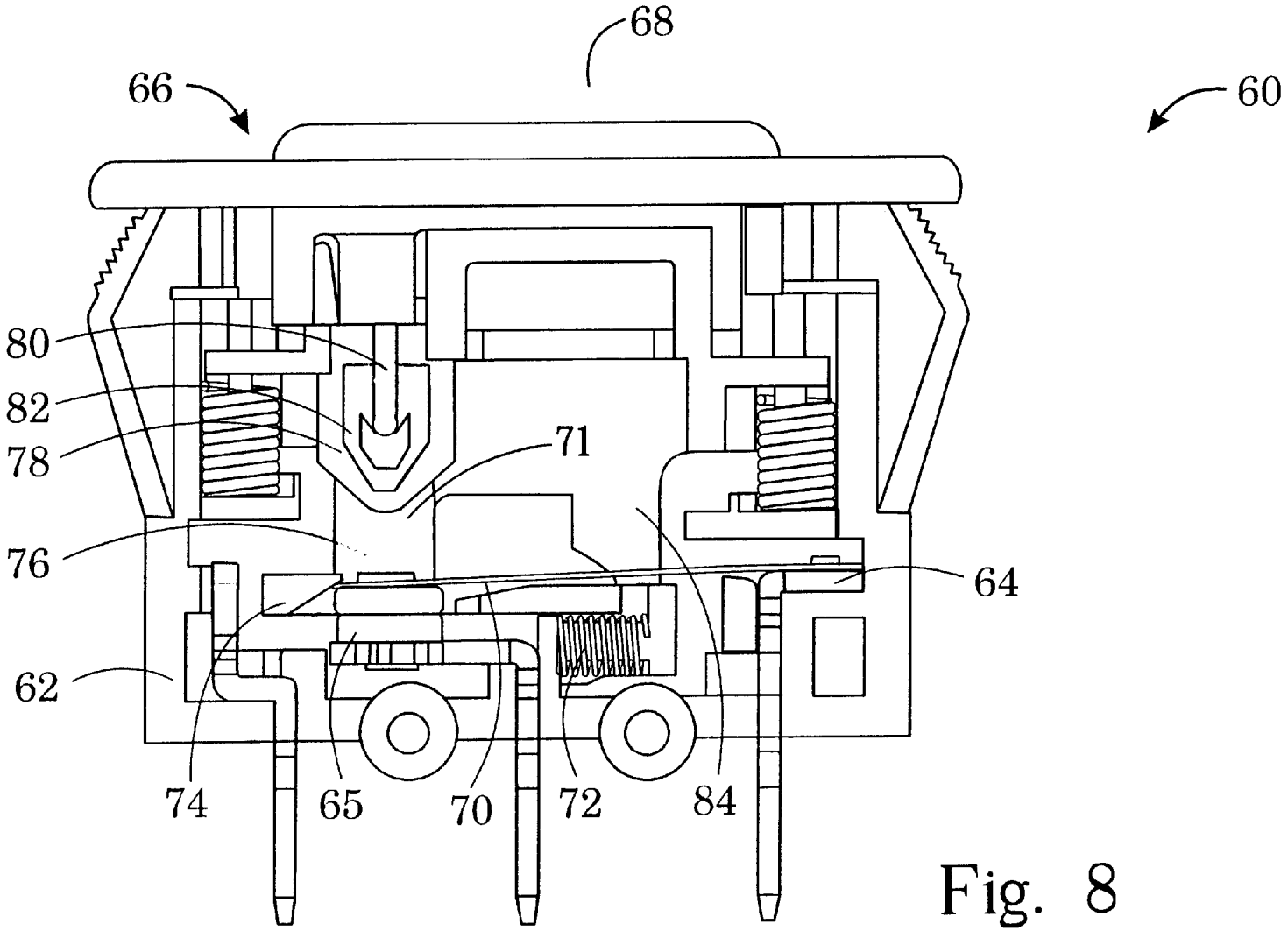
FIG. 8 is a cross-sectional view of the electric switch device in FIG. 7 in an "on" status.
Figure 9:
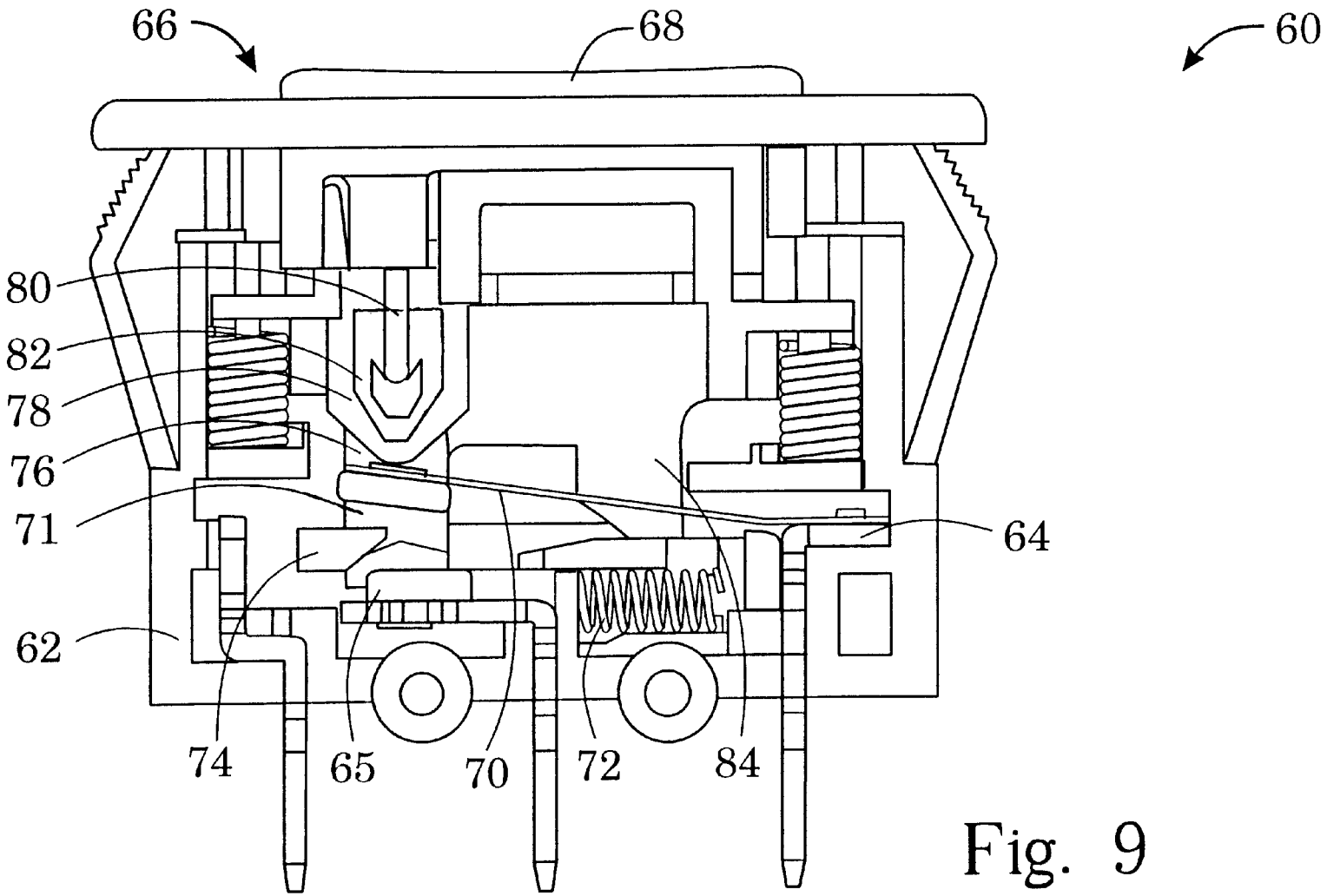
FIG. 9 is a cross-sectional view of the electric switch device in FIG. 7 in an "overheated" status.

Please refer to FIG. 7 to FIG. 9. FIG. 7 is a cross-sectional view of another electric switch device 60 in an "off" status according to the present invention. FIG. 8 is a cross-sectional view of the electric switchdevice 60 in FIG. 7 in an "on" status. FIG. 9 is a cross-sectional view of the electric switch device 60 in FIG. 7 in an "overheated" status. The electric switch device 60 comprises a housing 62, two electric terminals 64 and 65, a button mechanism 66, a conductive reed 70, an insulating unit 74 slidably installed in the housing 62, and an elastic mechanism 72 for pulling the insulating unit 74 against a front end of the reed 70. The elastic mechanism 72 is a spring and the reed 70 is an elastic reed over which the front end of the reed 70 is elastically attached to the second electric terminal 65 when the front end of the reed 70 is at a "down" position.

The button mechanism 66 comprises a push button 68, a hook 76, an engaging unit 84, a switching device 78, and a connecting rod 80. The push button 68 can be depressed to toggle between "on" and "off" statuses. The engaging unit 84 is used for engaging and horizontally pushing the insulating unit 74. The switching device 78 comprises a slot 82, and the connecting rod 80 can move upward and downward in the slot 82. FIG. 8 shows the position of the connecting rod 80 in the slot 82 and the position of a lower side 75 of the hook 76 in the housing 62 when the button 68 is pressed "on". FIG. 7 shows the position of the connecting rod 80 in the slot 82 and the position of the lower side 75 of the hook 76 in the housing 62 when the button 68 is pressed "off". The reed 70 comprises a rear end fixed to a first electric terminal 64 and electrically connected to the first electric terminal 64, and a front end moveably positioned above a second electric terminal 65 and between the switching device 78 and the lower side 75 of the hook 76.

When the button 68 is pressed "on" (as shown in FIG. 8), the lower side 75 of the hook 76 will move downward to allow the front end of the reed 70 to attach to the second electric terminal 65, and then the engaging unit 84 will allow the elastic mechanism 72 to push the insulating unit 74 against the front end of the reed 70 to hold it at the "down" position. Then, the reed 70 connects the two electric terminals 64, 65 to allow electric current to pass between the two electric terminals 64, 65.

When the button 68 is set to the "off" position (as shown in FIG. 7), the engaging unit 84 pushes the insulating unit 74 away from the front end of the reed 70 so as to allow the lower side 75 of the hook 76 to raise the front end of the reed 70 and fix it to the "up" position. Then, the second electric terminal 65 will disconnect from the first electric terminal 64 thus disabling electric current from passing between the two electric terminals 64, 65.

The reed 70 is formed by combining two metal pieces of different heat expansion coefficients such that when the current passing through the reed 70 exceeds the predetermined current level, the front end of the reed 70 will spring upward because of the heat generated by the current. As shown in FIG. 9, when the button 68 is set "on", a reserve space 71 exists above the reed 70 for the reed 70 to spring upward without pushing the button 68 upward, and the button 68 is still set "on". The elastic mechanism 72 will push the insulating unit 74 into a position between the front end of the reed 70 and the second electric terminal 65 to prevent the front end of the reed 70 from springing downward to contact the second electric terminal 65 when it cools down.

As shown in FIG. 9, although the electric switch device 60 is in an "off" status, the button 68 is set "on" and the connecting rod 80, the lower side 75 of the hook 76 and the engaging unit 84 are at "on" positions. When the user depresses the button 68, the button 68 will be set "off" and the connecting rod 80, the lower side 75 of the hook 76 and the engaging unit 84 willbe at "off" positions (as shown in FIG. 7). When the user depresses the button 68 again, the electric switch device 60 will be in an "on" status (as shown in FIG. 8). When the reed 70 springs upward because of the heat, the front end of the reed 70 will stay in the reserve space 71 without pushing the button 68 upward. If the button 68 is damaged or depressed such that it cannot be switched, the reed 70 still can spring upward. Then, the second electric terminal 65 will disconnect from the first electric terminal 64 to prevent the electric switch device 60 and devices connected to the electric switch device 60 from being damaged.

Compared with the prior art electric switch device 10, a reserve space exists above the reed 40, 70 of the electric switch device 30, 60. When the reed 40, 70 springs upward because of heat, the front end of the reed 40, 70 will pop up to the reserve space without pushing the button upward. If the button is damaged or depressed such that it cannot be switched, the reed 40, 70 can still spring upward. This will prevent damages to the electric switch device 30, 60 and devices connected to the electric switch device 30, 60.

Those skilled in the art will readily observe that numerous modifications and alterations of the propeller may be made while retaining the teachings of the invention. Accordingly, the above disclosure should be construed as limited only by the metes and bounds of the appended claims.

What is claimed is:

1. An electric switch device comprising:

a housing;

two electric terminals installed in the housing;

a button mechanism installed in the housing comprising a push button which can be depressed to toggle between "on" and "off" statuses;

a conductive reed installed in the housing for conducting electric current between the two electric terminals, the reed comprising a rear end fixed to a first electric terminal and a front end moveably positioned above a second electric terminal wherein when the button is pressed "on", the front end of the reed moves to a "down" position, touches the second electric terminal and electrically connects the two electric terminals, and when the button is pressed "off", the front end moves to an "up" position and disconnects the second electric terminal from the first electric terminal; and an elastic piece installed between the housing and the front end of the reed for elastically fixing the front end of the reed at the "up" or "down" position;

wherein the button mechanism comprises a hook installed below the button having a lower side for moving the front end of the reed upward and an upper side for pushing the front end of the reed downward, when the button is set "on", the upper side of the hook pushes the front end of the reed downward, the elastic piece elastically moves and fixes the front end of the reed to the "down" position, and a reserve space exists between the lower and upper sides of the hook for the reed to spring upward without pushing the button upward, when the button pops up to the "off" position, the lower side of the hook moves the front end of the reed upward and the elastic piece elastically moves and fixes the front end of the reed to the "up" position, and when the button is set "on" and the current passing through the reed exceeds a predetermined current level, the reed becomes heated, the front end of the reed springs upward into the reserve space, and the elastic piece elastically moves and fixes the front end of the reed to the "up" position so as to electrically disconnect the two electric terminals.

2. The electric switch device of claim 1 wherein the reed is formed by combining two metal pieces of different heat expansion coefficients whereby when the current passing through the reed exceeds the predetermined current level, the front end of the reed will spring upward because of the heat generated by the current.

3. An electric switch device comprising:

a housing;

two electric terminals installed in the housing;

a button mechanism installed in the housing comprising a push button which can be depressed to toggle between "on" and "off" statuses; and a conductive elastic reed installed in the housing for conducting electric current between the two electric terminals, the reed comprising a rear end fixed to a first electric terminal and a front end moveably positioned above a second electric terminal wherein when the button is pressed "on", the front end of the reed moves to a "down" position, elastically attaches to the second electric terminal and electrically connects the two electric terminals, and when the button is pressed "off", the front end moves to an "up" position and disconnects the second electric terminal from the first electric terminal;

wherein the bottom mechanism comprises a hook installed below the button having a lower side for moving the reed upward and an upper side above the lower side, when the button is set "on", the lower side of the hook moves downward to allow the front end of the reed to elastically move downward and to attach to the second electric terminal, and a reserve space exists between the lower and upper sides of the hook for the reed to spring upward without pushing the button upward, when the button is set "off", the lower side of the hook pulls the front end of the reed upward and fixes it to the "up" position, and when the button is "on" and the current passing through the reed exceeds a predetermined current level, the reed becomes heated and the front end of the reed springs upward into the reserve space so as to electrically disconnect the two electric terminals.

4. The electric switch device of claim 3 wherein the reed is formed by combining two metal pieces of different heat expansion coefficients whereby when the current passing through the reed exceeds the predetermined current level, the front end of the reed will spring upward because of the heat generated by the current.

5. The electric switch device of claim 3 further comprising an elastic piece installed between the housing and the front end of the reed for elastically fixing the front end of the reed at the "up" or "down" position.

6. The electric switch device of claim 3 further comprising an insulating unit slidably installed in the housing, an elastic mechanism for pushing the insulating unit against the front end of the reed, and an engaging unit for engaging and horizontally pushing the insulating unit wherein when the button is set to the "off" position, the engaging unit pushes the insulating unit away from the front end of the reed so as to allow the lower side of the hook to raise the front end of the reed and fix it to the "up" position, when the button is set to the "on" position, the lower side of the hook will move downward to allow the front end of the reed attach to the second electric terminal, and then the engaging unit will allow the elastic mechanism to push the insulating unit against the front end of the reed to hold it in the "down" position, and when the button is set "on" and the current passing through the reed exceeds the predetermined current level, the reed will be heated and the front end of the reed will spring upward across the insulating unit and the elastic mechanism will push the insulating unit into a position between the front end of the reed and the second electric terminal to prevent the front end of the reed from springing downward to contact the second electric terminal when it is cooled down.

* * * * *